US010167867B2

(12) United States Patent
Asami et al.

(10) Patent No.: US 10,167,867 B2
(45) Date of Patent: Jan. 1, 2019

(54) SCROLL FLUID MACHINE HAVING TIP SEAL MEMBER SEPARATED INTO DIFFERENT PORTIONS

(71) Applicant: ANEST IWATA Corporation, Kanagawa (JP)

(72) Inventors: Junichi Asami, Kanagawa (JP); Keiya Kato, Kanagawa (JP); Tamotsu Fujioka, Kanagawa (JP)

(73) Assignee: ANEST IWATA CORPORATION, Kanagawa (JP)

( * ) Notice: Subject to any disclaimer, the term of this patent is extended or adjusted under 35 U.S.C. 154(b) by 87 days.

(21) Appl. No.: 15/260,867

(22) Filed: Sep. 9, 2016

(65) Prior Publication Data

US 2017/0074265 A1 Mar. 16, 2017

(30) Foreign Application Priority Data

Sep. 10, 2015 (JP) ..... 2015-178897

(51) Int. Cl.
*F04C 27/00* (2006.01)
*F01C 19/00* (2006.01)
(Continued)

(52) U.S. Cl.
CPC ..... *F04C 27/005* (2013.01); *F01C 19/005* (2013.01); *F04C 18/0215* (2013.01);
(Continued)

(58) Field of Classification Search
CPC .. F01C 1/0284; F01C 1/0269; F04C 18/0261; F04C 27/005
(Continued)

(56) References Cited

U.S. PATENT DOCUMENTS 4,740,143 A 4/1988 Nakamura et al.
4,824,343 A 4/1989 Nakamura et al.
(Continued)

FOREIGN PATENT DOCUMENTS

DE 3614614 11/1986
EP 1 199 473 4/2002
(Continued)

OTHER PUBLICATIONS

Extended European Search Report dated Feb. 7, 2017 in corresponding European Application No. 16187786.5.

*Primary Examiner* — Mary A Davis
*Assistant Examiner* — Deming Wan
(74) *Attorney, Agent, or Firm* — Wenderoth, Lind & Ponack, L.L.P.

(57) ABSTRACT

A scroll fluid machine includes fixed and orbiting scrolls which define a compression chamber; a land which divides the compression chamber into first-stage and second-stage compression chambers; a wrap groove defined in a spiral shape along a tip of a fixed wrap of the fixed scroll; an intermediate groove defined in the land; a seal member; and an intermediate seal member. The land includes a first-stage outlet in communication with the first-stage compression chamber and a second-stage inlet in communication with the second-stage compression chamber. The wrap groove includes an outer peripheral wrap groove adjacent to the land on a radially outward side and an inner peripheral wrap groove adjacent to the land on a radially inward side. The intermediate groove is in communication with the outer and inner peripheral wrap grooves. The seal member is fitted in the wrap groove except the outer and inner wrap grooves.

3 Claims, 11 Drawing Sheets

(51) Int. Cl.

| | |
|---|---|
| ***F04C 18/02*** | (2006.01) |
| ***F04C 23/00*** | (2006.01) |
| ***F04C 28/02*** | (2006.01) |

(52) U.S. Cl.
CPC ..... *F04C 18/0261* (2013.01); *F04C 18/0284* (2013.01); *F04C 18/0292* (2013.01); *F04C 23/003* (2013.01); *F04C 28/02* (2013.01)

(58) Field of Classification Search
USPC ..... 418/55.1–55.6, 6, 8
See application file for complete search history.

(56) References Cited

U.S. PATENT DOCUMENTS

| | | | | |
|---|---|---|---|---|
| 4,883,413 | A * | 11/1989 | Perevuznik | F01C 19/08 267/153 |
| 6,682,328 | B2 * | 1/2004 | Kimura | F04C 18/0261 418/55.2 |
| 2002/0057976 | A1 | 5/2002 | Kimura et al. | |
| 2011/0070116 | A1 * | 3/2011 | Harashima | F01C 19/005 418/55.5 |

FOREIGN PATENT DOCUMENTS

| | | |
|---|---|---|
| EP | 1 908 962 | 4/2008 |
| JP | 10-61571 | 3/1998 |
| JP | 10-213081 | 8/1998 |
| JP | 2003-129970 | 5/2003 |

* cited by examiner

SCROLL FLUID MACHINE HAVING TIP SEAL MEMBER SEPARATED INTO DIFFERENT PORTIONS

CROSS-REFERENCE TO RELATED APPLICATION

The present application claims the priority of Japanese Patent Application No. 2015-178897 filed on Sep. 10, 2015. The disclosure of Japanese Patent Application No. 2015-178897 filed on Sep. 10, 2015 including the specification, the claims, the drawings, and the summary is incorporated herein by reference in its entirety.

TECHNICAL FIELD

The invention relates to a scroll fluid machine having a configuration wherein fluid is compressed in a first-stage compression section and fluid which has been compressed in the first-stage compression section is further compressed in a second-stage compression section.

BACKGROUND ART

According to conventional art, for example, the scroll fluid machine disclosed in Japanese Patent Application Publication (Kokai) No. 2003-129970 is so configured that a spiral-shaped orbiting wrap formed in an orbiting scroll is meshed with a spiral-shaped fixed wrap formed in a fixed scroll. The orbiting scroll is brought into an orbital motion to draw fluid from an inlet located on a radially outward side. A compression space into which the fluid is drawn is gradually decreased in size toward the center side, and thus the fluid is compressed. The compressed fluid is discharged from an outlet located on the center side. This scroll fluid machine includes a compression chamber divided into two stages, namely, a first-stage compression chamber located on the radially outward side and a second-stage compression chamber on the radially inward side. A first-stage outlet formed in the terminal end of the first-stage compression chamber and a second-stage inlet in communication with the drawing space of the second-stage compression chamber are piped together via a cooling device. The compressed fluid that has been compressed in the first-stage compression chamber is discharged from the first-stage outlet, refrigerated by passing through the cooling device, guided into the second-stage compression chamber through the second-stage inlet, and then compressed again. This prevents the heat generated by fluid compression from decreasing the life of the bearings and the seal members fitted in wrap grooves formed in the tips of wraps.

According to the invention illustrated in FIG. 2 of Japanese Patent Application Publication (Kokai) No. 2003-129970, the seal member includes a spiral-shaped first seal member fitted in the wrap groove and an intermediate seal member disposed between the first-stage outlet and the second-stage inlet. The intermediate seal member prevents compressed gas from escaping from the second-stage compression chamber side into the first-stage compression chamber side.

According to the invention illustrated in FIGS. 6 to 9 of the same publication, the seal member includes first and second seal members. The first seal member is arranged into a spiral which extends from the fluid-drawing side on the first-stage compression chamber side toward the outlet side of the second-stage compression chamber. The first seal member partitions the first-stage outlet from the second-stage inlet in between the first-stage and second-stage compression chambers. The second seal member includes an end which is in contact with the first seal member on the surface opposite to the inlet opening in proximity to the outlet opening. The second seal member stretches from the proximity of the outlet opening, extends around the second-stage compression chamber, reaches the proximity of the outlet opening, then comes into contact with the first seal member on the surface opposite to the outlet opening.

Technical Problem

According to the scroll fluid machine illustrated in FIG. 2 of Japanese Patent Application Publication (Kokai) No. 2003-129970, the seal member is slightly smaller in width than the wrap groove. For this reason, as shown in FIG. 14, the condition of contact between the end faces a1, a2 of the intermediate seal member a and the inner face b1 and the outer face b2 of the spiral-shaped seal member b possibly become unstable due to secular changes in long-term use, the orbital motion of the orbiting scroll, etc. An unstable contact might create a gap in each corner eat which an intermediate groove c intersects with a spiral wrap groove d, causing the compressed fluid to escape through the gaps.

According to the scroll fluid machine illustrated in FIGS. 6 to 9 of Japanese Patent Application Publication (Kokai) No. 2003-129970, while the fluid is being compressed in the compression space, the first seal member normally receives the pressure of the compressed fluid at the bottom face and is pressed against a mirror surface of the orbiting scroll. However, since a longitudinal and substantially intermediate portion of the first seal member is fitted in the intermediate groove in a bent position to partition the first-stage outlet from the second-stage inlet, there is the chance that the intermediate portion of the first seal member is not uniformly pressed against the mirror surface of the orbiting scroll by the pressure of the compressed fluid. If this occurs, the compressed fluid escapes from the second-stage compression chamber, passes through a portion which is pressed with low pressure, and enters the first-stage compression chamber.

In such circumstances, there has been a demand for a fluid machine configured to reliably prevent the compressed fluid which has been compressed in the second-stage compression chamber from escaping from the second-stage compression chamber into the first-stage compression chamber.

SUMMARY

Solution to Problem

A first embodiment of the present invention provides a scroll fluid machine. The scroll fluid machine includes a fixed scroll, an orbiting scroll, a land, a wrap groove, an intermediate groove, a seal member, and an intermediate seal member. The fixed scroll includes a first mirror surface and a fixed wrap protruding in a spiral shape from the first mirror surface to form a compression chamber. The orbiting scroll includes a second mirror surface opposed to the first mirror surface of the fixed scroll, and an orbiting wrap protruding in a spiral shape from the second mirror surface. The land is located at such a position as to divide the compression chamber into a first-stage compression chamber and a second-stage compression chamber. The land includes a first-stage outlet in communication with the first-stage compression chamber and a second-stage inlet in communication with the second-stage compression chamber. The wrap groove is formed in a spiral shape along a tip of the fixed wrap. The wrap groove includes an outer peripheral wrap groove adjacent to the first-stage outlet and the second-stage inlet on a radially outward side, and an inner peripheral wrap groove adjacent to the first-stage outlet and the second-stage inlet on a radially inward side. The intermediate groove is located in the land and communicates with the outer and inner peripheral wrap grooves. The seal member is fitted in the wrap groove except the outer and inner peripheral wrap grooves. The intermediate seal member includes an outer peripheral seal portion fitted in the outer peripheral wrap groove, an inner peripheral seal portion fitted in the inner peripheral wrap groove, and an intermediate seal portion fitted in the intermediate groove and connected to the outer and inner peripheral seal portions.

In a second embodiment of the invention according to the first embodiment, the seal member fitted in the wrap groove includes a first seal member, a second seal member, and a third seal member. The first seal member includes a second end face in contact with a first end face of the outer peripheral seal portion, and extends in a spiral shape from the second end face in a radially outward direction. The second seal member includes a fourth end face in contact with a third end face of the outer peripheral seal portion, which is on an opposite side to the first end face, and a sixth end face in contact with a fifth end face of the inner peripheral seal portion, the sixth end face being on an opposite side to the fourth end face. The second seal member extends in a spiral shape from the fourth end face to the sixth end face in a radially inward direction. The third seal member includes an eighth end face in contact with a seventh end face of the inner peripheral seal portion, which is on an opposite side to the fifth end face. The third seal member extends in a spiral shape from the eighth end face in the radially inward direction.

In a third embodiment of the invention according to the first or second embodiment, a plurality of cuts are formed in a lateral face of the intermediate seal member at an angle to a direction orthogonal to a longitudinal direction to therefore form a plurality of elastically deformable lips.

In a fourth embodiment of the invention according to any one of the first to third embodiments, a backup ring made of elastic material is provided on a bottom face of the intermediate seal member.

DETAILED DESCRIPTION

An embodiment of the present invention will be described with reference to FIGS. 1 to 9. The inventions claimed in the claims of the present patent application are not limited to the embodiment described below. Combinations of the features discussed in the embodiment are not necessarily all required for solution by the invention. Orientations mentioned in the following description are based on FIG. 1.

Figure 1:
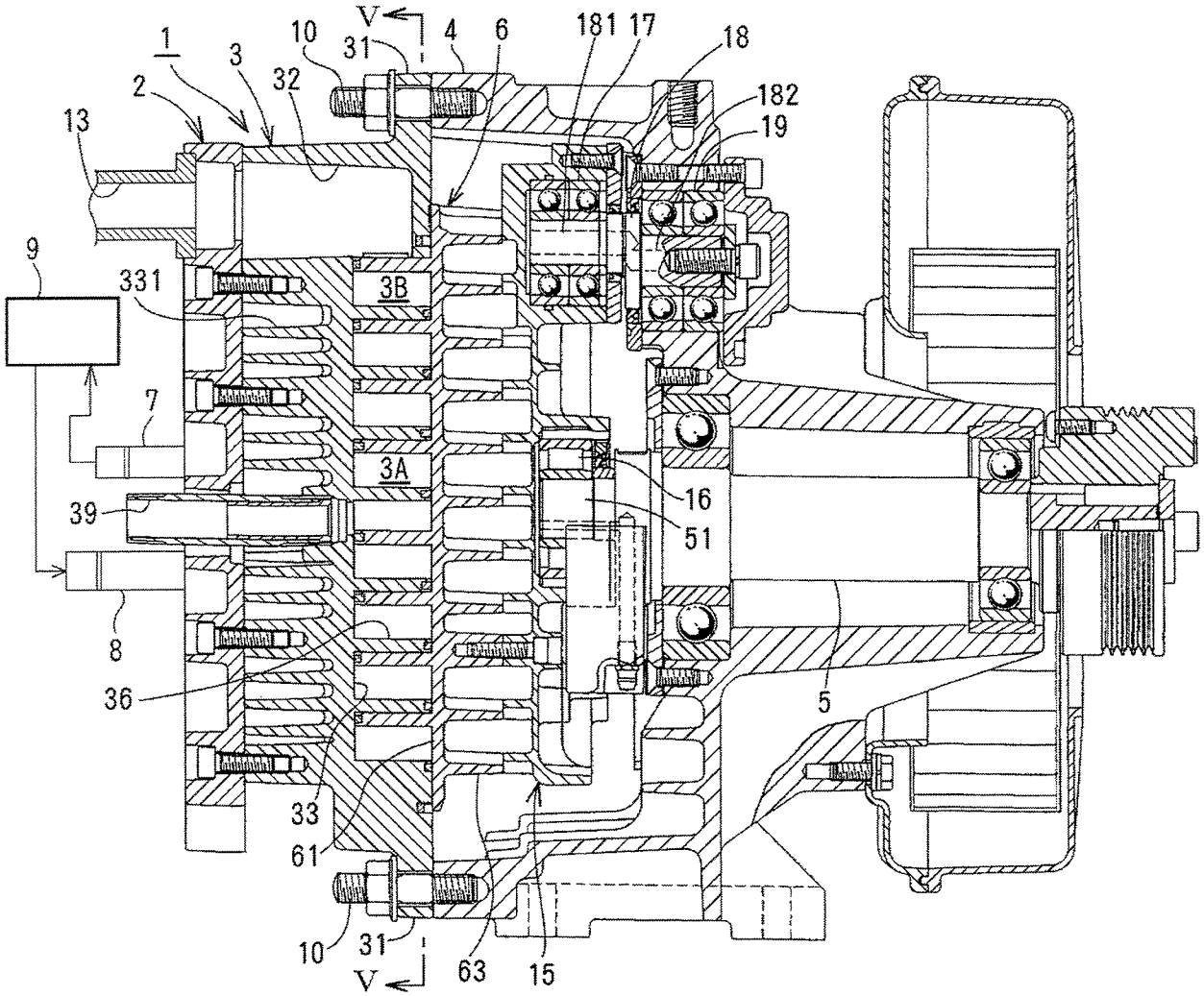
FIG. 1 is a vertical cross-sectional representation view of a scroll fluid machine according to an embodiment of the present invention.

FIG. 1 is a vertical cross-sectional representation view of a scroll fluid machine 1 according to the embodiment of the present invention. Shown in FIG. 1, the scroll fluid machine 1 includes a fixed scroll 3, a drive shaft housing 4, a drive shaft 5, and an orbiting scroll 6. In one example, the fixed scroll 3 is made from aluminum alloy or the like. A housing cover 2 is fixed to a front face of the fixed scroll 3. A surface facing a back side of the fixed scroll 3 is fixed to the drive shaft housing 4. The drive shaft 5 is rotatably supported with the drive shaft housing 4 and rotated by, not shown, motor. The drive shaft 5 extends in a front-back direction of scroll fluid machine 1. In one example, the orbiting scroll is made from aluminum alloy or the like. The orbiting scroll integrally orbits with the drive shaft 5.

A cooling chamber 9 is disposed between a discharge conduit 7 attached to a first-stage outlet 34 (FIG. 2) disposed in an first-stage compression chamber 3A (FIG. 2) of the fixed scroll 3 and a suction conduit 8 attached to a second-stage inlet 35 (FIG. 2) disposed in an second-stage compression chamber 3B (FIG. 2) of the fixed scroll 3. The discharge conduit 7 and the cooling chamber 9 are connected together through a conduit. The suction conduit 8 and the cooling chamber 9 are connected together through another conduit. Compressed fluid which has been compressed in the first-stage compression chamber 3A is introduced from the first-stage outlet 34 through the discharge conduit 7 into the cooling chamber 9 to be refrigerated. After being refrigerated in the cooling chamber 9, the compressed fluid is sucked from the second-stage inlet 35 through the suction conduit 8 into the second-stage compression chamber 3B for further compression.

Figure 2:
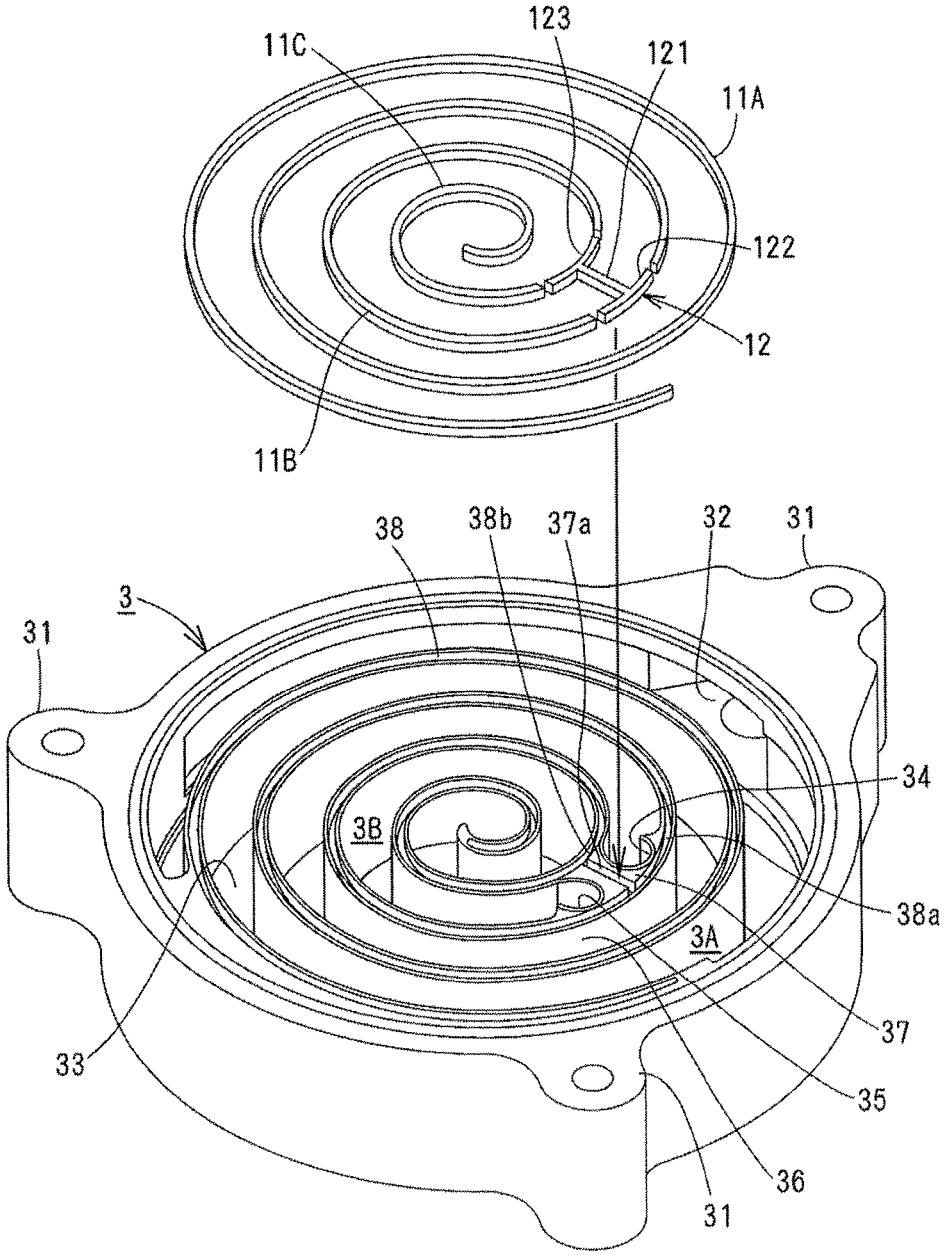
FIG. 2 is a perspective representation view of a fixed scroll and a seal member according to the embodiment of the present invention.
Figure 3:
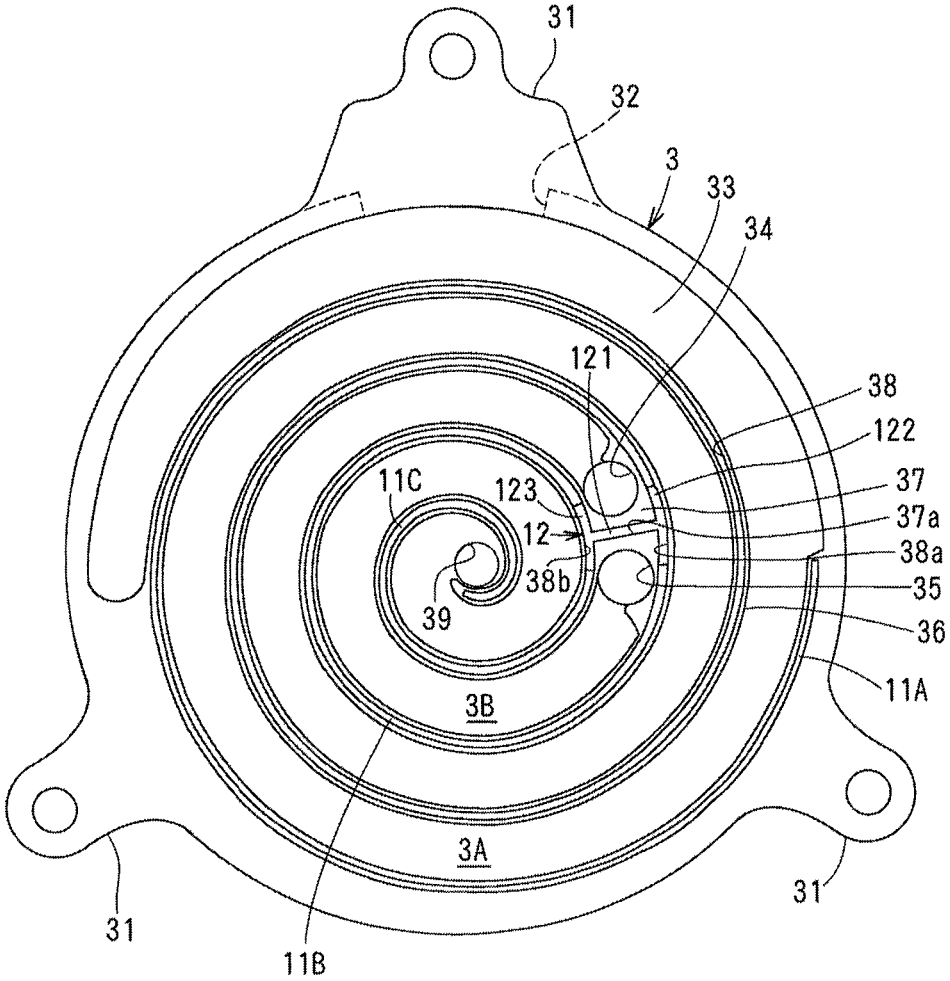
FIG. 3 is an elevation representation view of the fixed scroll according to the embodiment of the present invention.

As shown in FIGS. 2 and 3, the fixed scroll 3 is formed to have a circular tray-like shape. The fixed scroll 3 has an outer peripheral face which is provided with three fixing portions 31 for fixing the fixed scroll 3 to the drive shaft housing 4 with bolts 10 (see FIG. 1) and a first-stage inlet 32 for sucking in the fluid.

As shown in FIG. 1, a plurality of cooling fins 331 are disposed on a back side of a first mirror surface 33, namely a front side of the fixed scroll 3, of the fixed scroll 3. The housing cover 2 is fixed to tips of the cooling fins 331. A conduit 13 in communication with the first-stage inlet 32 of the fixed scroll 3 is attached to the housing cover 2. This configuration allows the fluid to be sucked into the first-stage inlet 32 through the conduit 13.

The first mirror surface 33 which forms a bottom face of a recessed portion of the fixed scroll 3 is provided with a spiral-shaped fixed wrap 36, a land 37, the first-stage outlet 34, the second-stage inlet 35, and a second-stage outlet 39 for discharging the fluid compressed in the second-stage compression chamber 3B (FIG. 2). The land 37 divides the spiral-shaped compression chamber formed with the fixed wrap 36 into the first-stage compression chamber 3A located on the radially outward side and the second-stage compression chamber 3B located on the radially inward side.

The first-stage outlet 34 is formed in the land 37 and communicates with a terminal end of the first-stage compression chamber 3A. The second-stage inlet 35 is formed in the land 37 and communicates with a start end of the second-stage compression chamber 3B. The second-stage outlet 39 is formed in a substantially center of the first mirror surface 33 and communicates with a terminal end of the second-stage compression chamber 3B.

A wrap groove 38 is formed in a tip of the fixed wrap 36 to have a spiral shape along the tip. As shown mainly in FIGS. 2 and 6, a seal member including a first seal member 11A, a second seal member 11B, and a third seal member 11C is fitted in the wrap groove 38 along the fixed wrap 36, except after-mentioned outer and inner peripheral wrap grooves 38*a* and 38*b*. An outer peripheral seal portion 122 and an inner peripheral seal portion 123 of an intermediate seal member 12 are respectively fitted in the outer peripheral wrap groove 38*a* and the inner peripheral wrap groove 38*b*. The first seal member 11A is formed in the spiral shape and located on a radially outermost side. The second seal member 11B is formed in the spiral shape and indirectly connected to an inner terminal end of the first seal member 11A. The third seal member 11C is formed in the spiral shape and indirectly connected to an inner terminal end of the second seal member 11B.

The first seal member 11A, the second seal member 11B, the third seal member 11C, and the intermediate seal member 12 are made from self-lubricating material. Examples of self-lubricating material include fluorine-based resin. While the fluid is being compressed in the compression space, the first seal member 11A, the second seal member 11B, the third seal member 11C, and the intermediate seal member 12 receive the pressure of the compressed fluid at bottom faces thereof, and are thus pressed against a second mirror surface 61 of the orbiting scroll 6. The first seal member 11A, the second seal member 11B, the third seal member 11C, and the intermediate seal member 12 thus come into slidable contact with the second mirror surface 61 of the orbiting scroll 6 to seal the compression chambers 3A and 3B.

The land 37 of the fixed scroll 3 is located at such a position as to partition the first-stage compression chamber 3A and the second-stage compression chamber 3B from each other. The land 37 has such a shape as to connect radially adjacent lateral faces of the fixed wrap 36. A straight intermediate groove 37*a* is formed in a face of the land 37, which is opposed to the second mirror surface 61 of the orbiting scroll 6. As shown mainly in FIG. 7A, an end of the intermediate groove 37*a*, which is located on the radially outward side, communicates with the outer peripheral wrap groove 38*a* of the wrap groove 38, which is adjacent to the land 37, the first-stage outlet 34, and the second-stage inlet 35 on the radially outward side. Similarly, the other end of the intermediate groove 37*a*, which is located on the radially inward side, communicates with the inner peripheral wrap groove 38*b* of the wrap groove 38, which is located adjacent to the land 37, the first-stage outlet 34, and the second-stage inlet 35 on the radially inward side. The term "radially" indicates either direction along a radius of the first mirror surface 33 of the fixed scroll 3. The "radially outward" means the direction which is toward the outer periphery of the first mirror surface 33. The "radially inward" means the direction which is toward the center of the first mirror surface 33.

Figure 5:
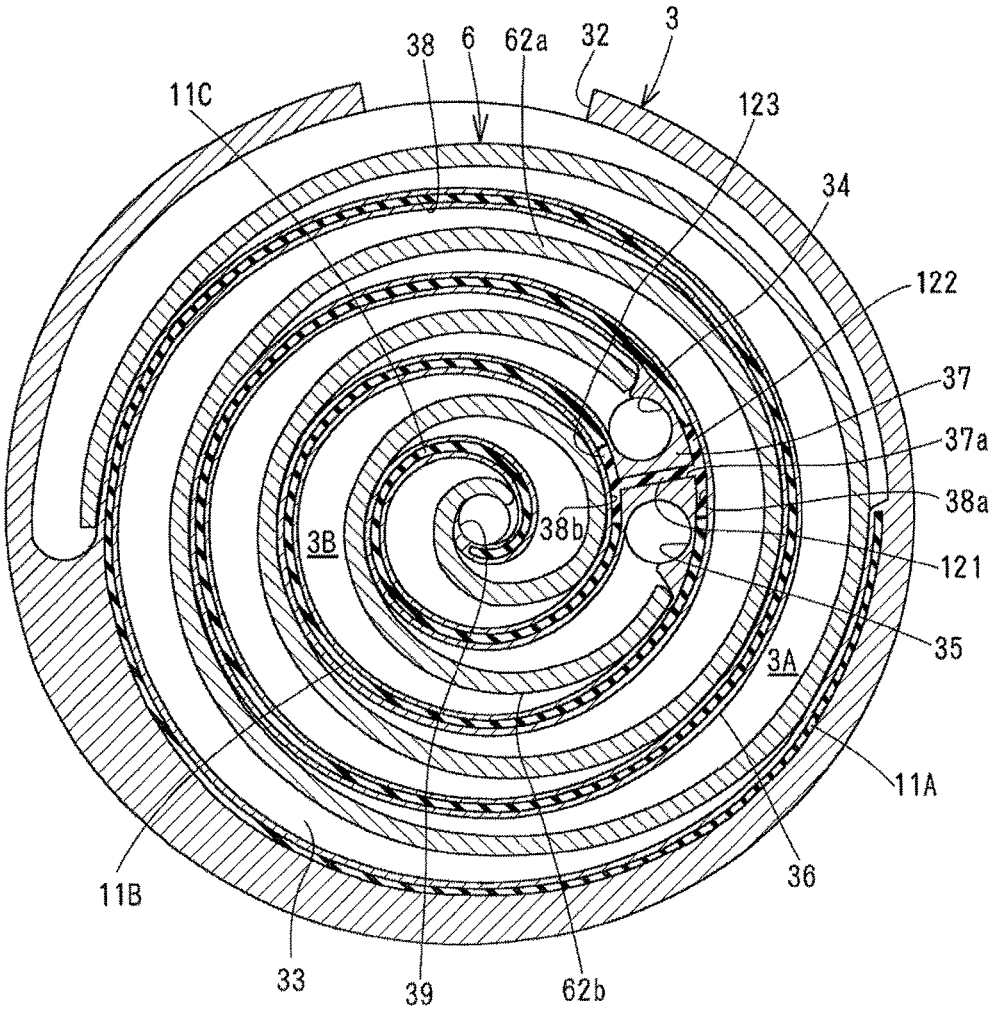
FIG. 5 is a cross-sectional representation view of the scroll fluid machine, taken along line V-V of FIG. 1.
Figure 6:
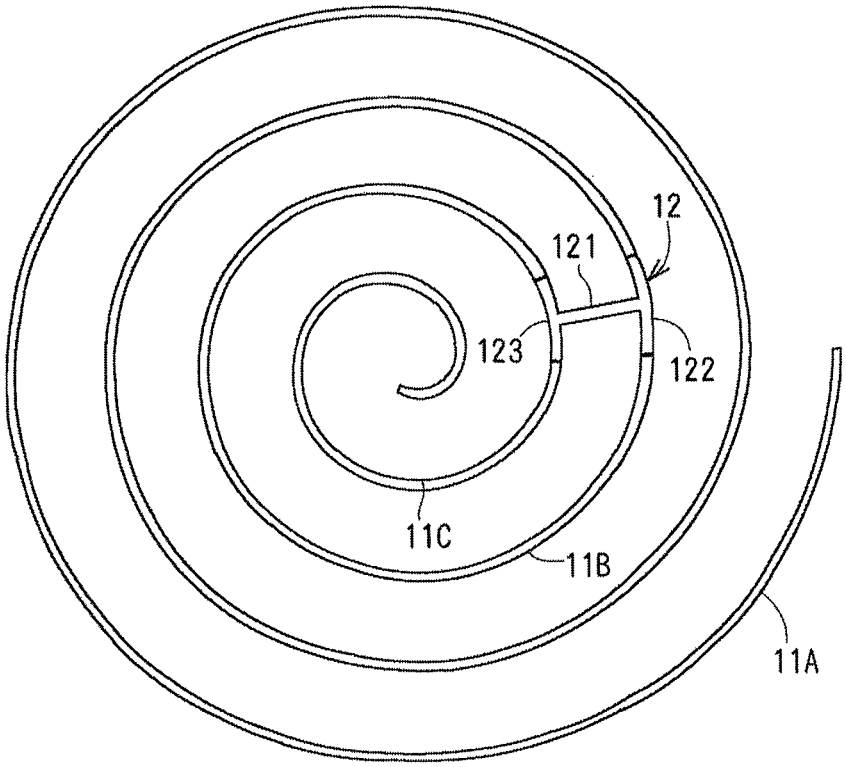
FIG. 6 is an elevation representation view of the seal member.

As shown mainly in FIGS. 2, 5 and 6, the intermediate seal member 12 which has a generally H shape in a planar view of the intermediate seal member is fitted in the intermediate groove 37*a*, the outer peripheral wrap groove 38*a*, and the inner peripheral wrap groove 38*b*. The intermediate seal member 12 prevents the compressed gas compressed in the second-stage compression chamber 3B from escaping from the second-stage compression chamber 3B into the first-stage compression chamber 3A and being pumped back into the second-stage compression chamber 3B.

Figure 7A:
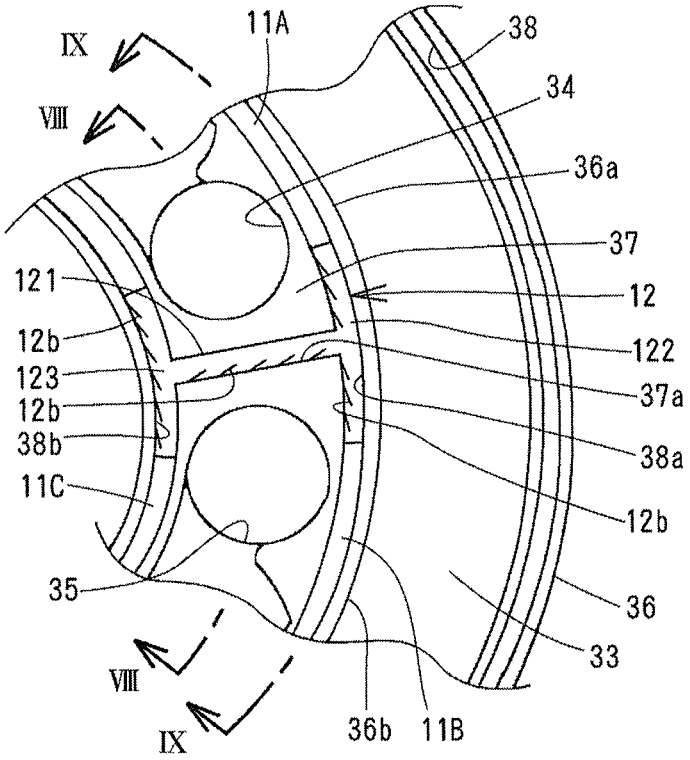
FIG. 7A is an enlarged elevation representation view of a relevant part of the fixed scroll.
Figure 7B:
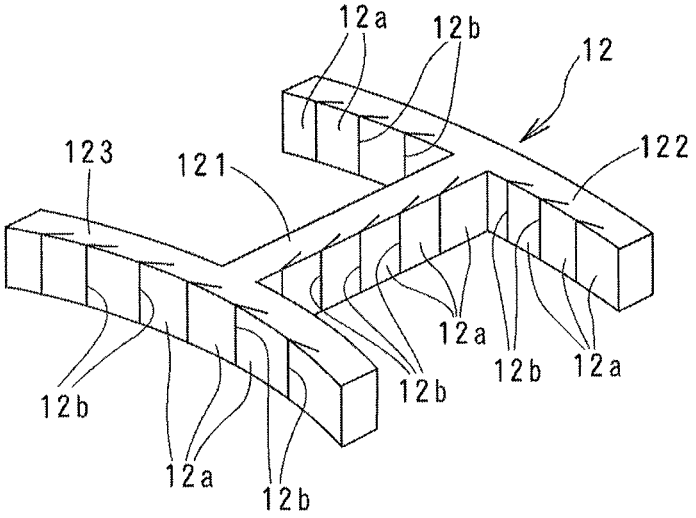
FIG. 7B is an enlarged perspective representation view of an intermediate seal member.
Figure 8:
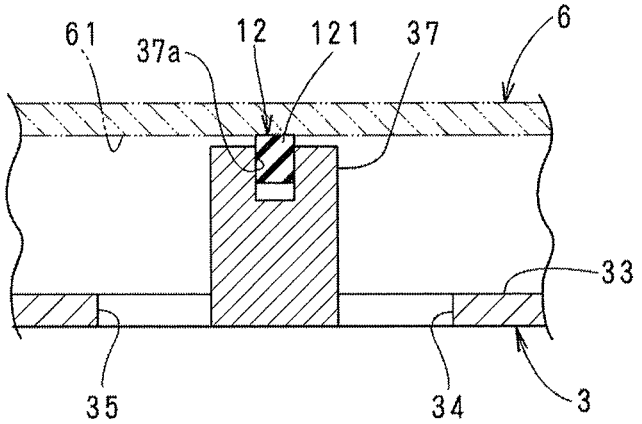
FIG. 8 is a cross-sectional representation view of the fixed scroll, taken along line VIII-VIII of FIG. 7A.
Figure 9:
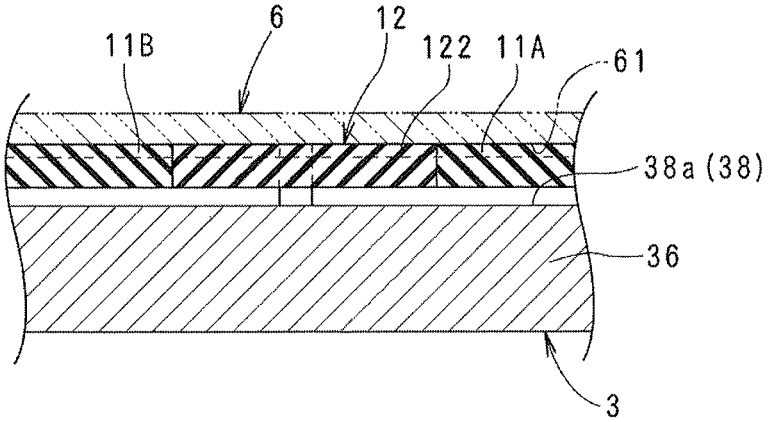
FIG. 9 is a cross-sectional representation view of the fixed scroll, taken along line IX-IX of FIG. 7A.

FIG. 7A is an enlarged elevation representation view of a relevant part of the fixed scroll. FIG. 7B is an enlarged perspective representation view of an intermediate seal member. FIG. 8 is a cross-sectional representation view of the fixed scroll, taken along line VIII-VIII of FIG. 7A. FIG. 9 is a cross-sectional representation view of the fixed scroll, taken along line IX-IX of FIG. 7A.

The intermediate seal member 12 includes an intermediate seal portion 121, an outer peripheral seal portion 122, and an inner peripheral seal portion 123, which are integrally formed. The intermediate seal portion 121 has a straight shape and is fitted in the intermediate groove 37*a*. The outer peripheral seal portion 122 is connected to an end of the intermediate seal portion 121, which is located on the radially outward side. The outer peripheral seal portion 122 is fitted in the outer peripheral wrap groove 38*a* and extends along the tip of the fixed wrap 36 by predetermined distance. An inner peripheral seal portion 123 is connected to an end of the intermediate seal portion 121, which is located on the radially inward side. The inner peripheral seal portion 123 is fitted in the inner peripheral wrap groove 38*b* and extends along the tip of the fixed wrap 36 by predetermined distance.

The intermediate seal portion 121, the outer peripheral seal portion 122, and the inner peripheral seal portion 123 include lateral faces each provided with a plurality of cuts 12*b* formed at an angle to a direction orthogonal to a longitudinal direction so that a plurality of lips 12*a* are formed in the lateral faces along the longitudinal direction as shown in FIGS. 7A and 7B. While the fluid is being compressed in the compression space, therefore, due to the pressure of the compressed fluid which has entered into gaps of the cuts 12*b*, the lips 12*a* formed in the intermediate seal portion 121 are pressed against a lateral wall face of the intermediate groove 37*a*, the lips 12*a* formed in the outer peripheral seal portion 122 are pressed against a lateral wall face of the outer peripheral wrap groove 38*a*, and the lips 12*a* formed in the inner peripheral seal portion 123 are pressed against a lateral wall face of the inner peripheral wrap groove 38*b*. As a result, areas to be sealed are tightly sealed, which makes more reliable the prevention of escape of the compressed fluid.

As shown in FIG. 3, the first seal member 11A is fitted in the wrap groove 38 of the fixed wrap 36 which forms the first-stage compression chamber 3A. The first seal member 11A extends along the tip of the fixed wrap 36. The second end face which is an end face of an inner end of the first seal member 11A is in substantially tight contact with a first end face which is an end face, namely end face facing upward in FIG. 3, of the outer peripheral seal portion 122 of the intermediate seal member 12. The first seal member 11A extends in the spiral shape from the second end face along the tip of the fixed wrap 36 in the radially outward direction. The second seal member 11B includes a fourth end face in substantially tight contact with a third end face which is the other end face, namely face facing downward in FIG. 3, opposed to the first end face of the outer peripheral seal portion 122 of the intermediate seal member 12. The second seal member 11B further includes a sixth end face opposed to the fourth end face, which is in substantially tight contact with a fifth end face which is an end face, namely end face facing upward in FIG. 3, of the inner peripheral seal portion 123 of the intermediate seal member 12. The second seal member 11B extends in the spiral shape from the fourth end face to the sixth end face along the tip of the fixed wrap 36 in the radially inward direction. The third seal member 11C includes an eighth end face in contact with a seventh end face which is the other end face, namely end face facing downward in FIG. 3, opposed to the fifth end face of the inner peripheral seal portion 123 of the intermediate seal member 12. The third seal member 11C extends in the spiral shape from the eighth end face to the proximity of the second-stage outlet 39 in the radially inward direction along the tip of the fixed wrap 36.

Figure 4:
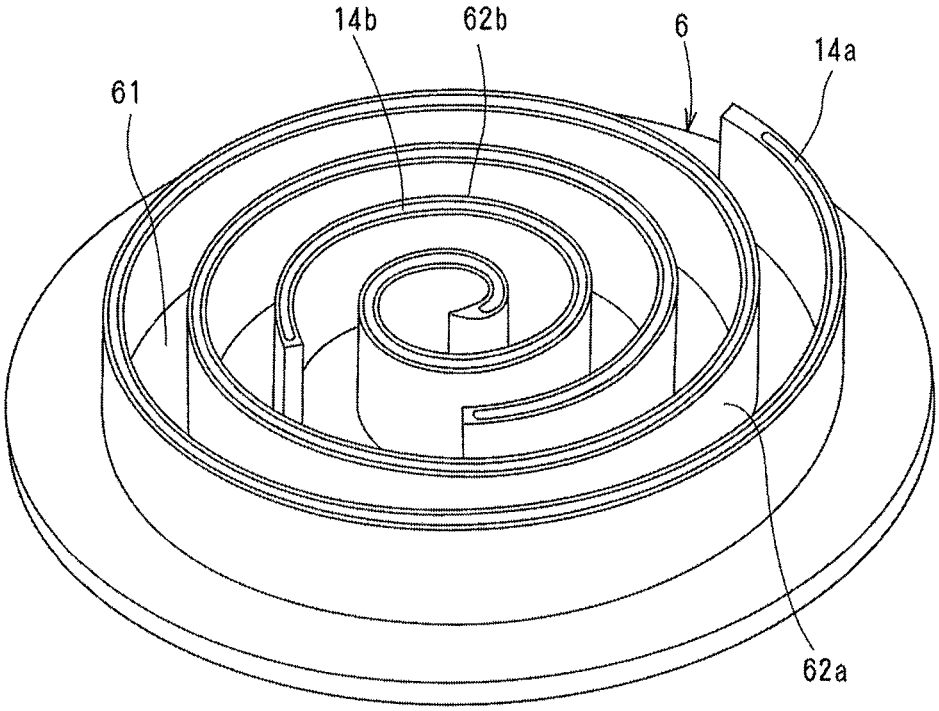
FIG. 4 is a perspective representation view of an orbiting scroll according to the embodiment of the present invention.

The orbiting scroll 6 includes the second mirror surface 61 opposed to the first mirror surface 33 of the fixed scroll 3. As shown in FIG. 4, the second mirror surface 61 is provided with a spiral-shaped first-stage orbiting wrap 62*a* located on the radially outward side and a spiral-shaped second-stage orbiting wrap 62*b* located on the radially inward side. Each of the orbiting wraps 62*a* and 62*b* includes a tip provided with a spiral-shaped wrap groove. Fitted in the wrap grooves are a seal member 14*a* on the radially outward side and a seal member 14*b* on the radially inward side. The seal members 14*a* and 14*b* are made from self-lubricating material to have a spiral shape. Examples of self-lubricating material include fluorine-based resin. The seal members 14*a* and 14*b* are in slidable contact with the first mirror surface 33 of the fixed scroll 3 to seal the compression chambers 3A and 3B.

As shown in FIG. 5, the first-stage orbiting wrap 62*a* is superposed on and meshed with the lateral face of the fixed wrap 36. With this configuration, the first-stage orbiting wrap 62*a* gradually decreases the volume of the compression chamber, which is formed between the fixed scroll 3 and the orbiting scroll 6 within the first-stage compression chamber 3A, as approaching radially inward along the circumferential direction of the scroll. The second-stage orbiting wrap 62*b* meshes with the lateral face of the fixed wrap 36 in a position facing the lateral face of the fixed wrap 36. The second-stage orbiting wrap 62*b* gradually decreases the volume of the compression chamber, which is formed between the fixed scroll 3 and the orbiting scroll 6 within the second-stage compression chamber 3B, as approaching the center along the circumferential direction of the scroll.

As shown in FIG. 1, a plurality of cooling fins 63 are disposed in a rear side, namely back side of the orbiting scroll 6, of the second mirror surface 61 of the orbiting scroll 6. An auxiliary cover 15 is fixed to tips, namely rear portions, of the cooling fins 63.

A bearing 16 is disposed in the center of the auxiliary cover 15. An eccentric shaft portion 51 of the drive shaft 5 is rotatably fitted in the bearing 16. The auxiliary cover 15 is circumferentially divided into three areas. A bearing 17 supporting a crank member 18 for preventing the rotation of the orbiting scroll 6 is disposed in one of the three areas located on the radially outward side. Although omitted in the drawings, the others are also provided with the bearing 17 which supports the crank member 18 for preventing the rotation of the orbiting scroll 6.

The crank member 18 includes a shaft portion 181 in the front thereof. The shaft portion 181 is inserted in the bearing 17 on the auxiliary cover 15 side. A shaft portion 182 disposed in the rear of the crank member 18 is located eccentrically relative to the shaft portion 181 and inserted in a bearing 19 disposed in the drive shaft housing 4. Due to an eccentric rotation of the eccentric shaft portion 51 of the drive shaft 5, the orbiting scroll 6 makes an orbital motion relative to the fixed scroll 3.

In the scroll fluid machine 1 configured as described above, the drive shaft 5 rotes and the eccentric shaft portion 51 turns around the center of the drive shaft 5. Thereby the orbiting scroll 6 orbits. Fluid is accordingly sucked in from the first-stage inlet 32 of the fixed scroll 3. The fluid which has been sucked in from the first-stage inlet 32 is guided inward with the first-stage orbiting wrap 62*a*. The fluid is then gradually compressed as running radially inward along the circumferential direction within the first-stage compression chamber 3A and discharged from the first-stage outlet 34. The fluid passes through the discharge conduit 7, the cooling chamber 9, and the suction conduit 8 to be refrigerated, and then guided into the second-stage compression chamber 3B from the second-stage inlet 35. The compressed fluid which has been guided into the second-stage compression chamber 3B is further compressed by degrees as running toward the center side along the circumferential direction within the second-stage compression chamber 3B. The compressed fluid is eventually delivered to a center portion and discharged from the second-stage outlet 39.

Conventional art provides an intermediate seal member between the first-stage outlet and the second-stage inlet for use in the above-described fluid compression process. As already discussed, the conventional art involves a problem that the fluid compressed in the second-stage compression chamber escapes from the proximity of a corner at which the intermediate groove and the wrap groove intersect with each other and enters the first-stage compression chamber in a pressure environment lower than the second-stage compression chamber. In contrast, the intermediate seal member 12 of the present embodiment includes the intermediate seal portion 121 fitted in the intermediate groove 37*a* formed between the first-stage outlet 34 and the second-stage inlet 35, the outer peripheral seal portion 122 fitted in the wrap groove 38*a* on the radially outward side, and the inner peripheral seal portion 123 fitted in the wrap groove 37*b* on the radially inward side, which are integrally molded. The intermediate seal member 12 therefore has the generally H shape in the planar view of the intermediate seal member. With this configuration, there is no gap in the corner at which the intermediate groove 37*a* intersects with the wrap grooves 38*a* and 38*b*. The intermediate seal member 12 thus reliably prevents the compressed fluid from escaping from the second-stage compression chamber 3B into the first-stage compression chamber 3A. To be more specific, the intermediate seal member 12 prevents the compressed fluid from escaping, being mixed into the compressed fluid in the first-stage compression chamber 3A, and being pumped back into the second-stage compression chamber 3B.

Furthermore, a gap is unlikely to be created between the contact faces. Because the longitudinal end faces of the first, second and third seal members 11A, 11B and 11C respectively come into contact with the end faces of the outer peripheral seal portion 122 and the inner peripheral seal portion 123 of the intermediate seal member 12. This makes it possible to prevent the compressed fluid from escaping from the downstream compression chamber into the upstream compression chamber.

The intermediate seal member 12 is formed separately from the first, second and third seal members 11A, 11B and 11C which are longer in length than the intermediate seal member 12. This configuration allows the intermediate seal member 12 to receive the pressure of the compressed fluid at the bottom face thereof and press the intermediate seal member 12 against the second mirror surface 61 of the orbiting scroll 6 in a substantially uniform manner while the fluid is being compressed in the compression space. The "substantially uniform" here means to be "uniform" enough, as compared to the conventional art, to prevent or reduce the escape of the compressed fluid from the second-stage compression chamber into the first-stage compression chamber.

The intermediate seal member 12 includes a lateral face provided with the plurality of cuts 12*b* formed at an angle to the direction orthogonal to the longitudinal direction and the lips 12*a*, which are elastically deformable. The lips 12*a* accordingly receive the pressure of the compressed fluid which has flowed into the gaps of the cuts 12*b*, and are pressed against the lateral wall faces of the intermediate groove 37*a*, the wrap groove 38*a*, and the wrap groove 38*b*. As a result, the areas to be sealed are tightly sealed, which makes it possible to reliably prevent the escape of the compressed fluid.

The one embodiment of the invention has been described. Various modification or variations may be made to the present embodiment as below without deviating from the gist of the invention.

Figure 10:
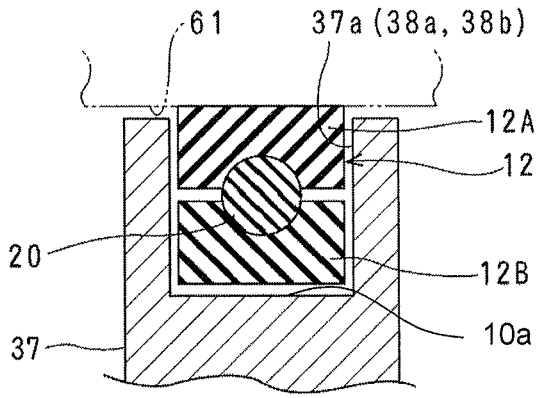
FIG. 10 is an enlarged cross-sectional representation view of a relevant part of the fixed scroll, illustrating first modification example.

(1) Amongst the first, second and third seal members 11A, 11B and 11C and the intermediate seal member 12, at least the intermediate seal member 12 may be divided in a direction parallel with the second mirror surface 61 into two including an upper seal member 12A in slidable contact with the second mirror surface 61 of the orbiting scroll 6 and a lower seal member 12B facing a bottom face 10*a* which is a part of the intermediate groove 37*a* and the wrap grooves 38*a* and 38*b*, for example, as shown in a cross-sectional view of FIG. 10. A backup ring 20 made from elastic material may be fitted in semicircular grooves formed in dividing faces of the upper and lower seal members 12A and 12B. In the above-described configuration, a contact face of the upper seal member 12A is pressed against the second mirror surface 61 by the pressure of the compressed fluid flowing into a gap between the upper and lower seal members 12A and 12B within the intermediate groove 37*a* and the wrap grooves 38*a* and 38*b*, and by elastic energy of the backup ring 20. This configuration makes more reliable the prevention of escape of the compressed fluid.

Figure 11:
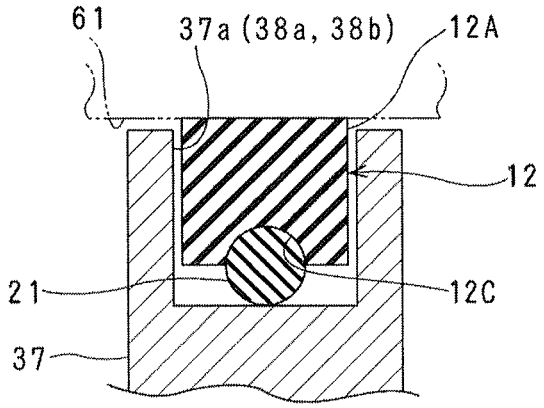
FIG. 11 is an enlarged cross-sectional representation view of a relevant part of the fixed scroll, illustrating second modification example.
Figure 12:
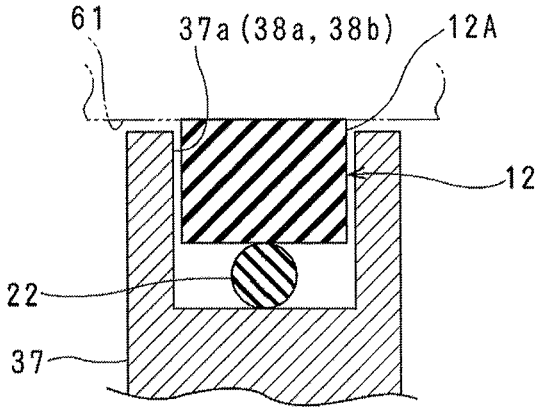
FIG. 12 is an enlarged cross-sectional representation view of a relevant part of the fixed scroll, illustrating third modification example.

(2) As shown in FIG. 11, a backup ring 21 made from elastic material and having a circular cross-section may be fitted in a semicircular groove 12*c* formed in the bottom face of the intermediate seal member 12. Alternatively, as shown in FIG. 12, a backup ring 22 made from elastic material and having a circular cross-section may be provided between the flat bottom face of the intermediate seal member 12 and the bottom faces of the intermediate groove 37*a* and the wrap grooves 38*a* and 38*b*. In the above-described configuration, the contact face of the intermediate seal member 12 is pressed against the second mirror surface 61 by the pressure of the compressed fluid flowing into a gap between the bottom face of the intermediate seal member 12 and the bottom faces of the intermediate groove 37*a* and the wrap grooves 38*a* and 38*b*, and by elastic energy of the backup ring 21 or 22. This makes it possible to reliably prevent the escape of the compressed fluid.

Figure 13:
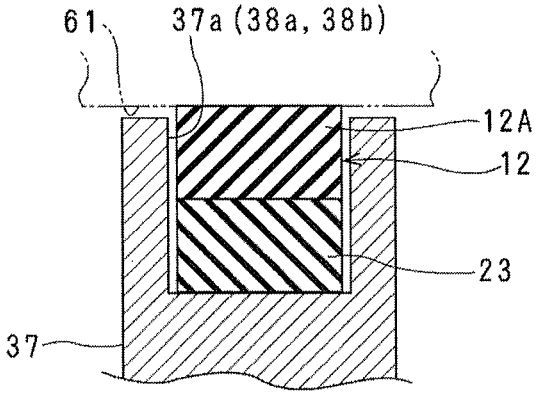
FIG. 13 is an enlarged cross-sectional representation view of a relevant part of the fixed scroll, illustrating fourth modification example.
Figure 14:
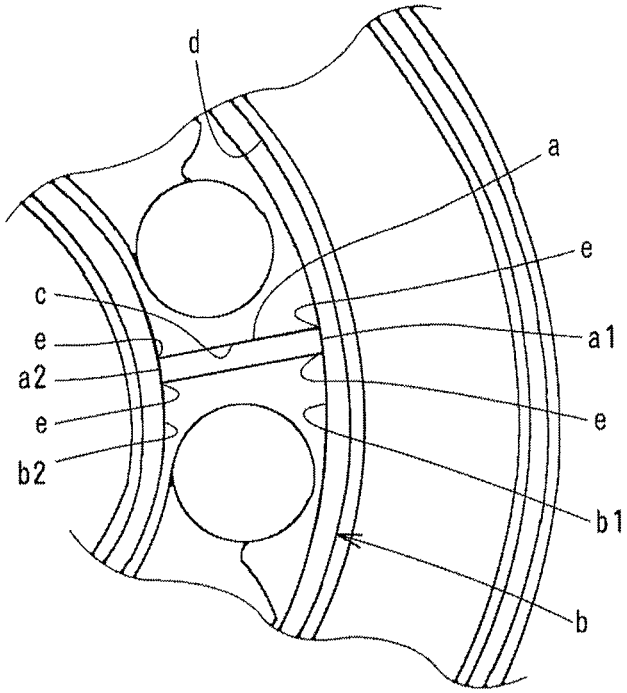
FIG. 14 is an enlarged elevation representation view of a relevant part of the fixed scroll, illustrating conventional art.

(3) As shown in FIG. 13, an elastic element 23 may be disposed between the bottom face of the intermediate seal member 12, and the bottom faces of the intermediate groove 37*a* and the wrap grooves 38*a* and 38*b*. The elastic element 23 has a rectangular cross-section and has a stronger elastic action than the intermediate seal member 12. In the above-described configuration, the contact face of the intermediate seal member 12 is pressed against the second mirror surface 61 by the pressure of the compressed fluid flowing into a gap between a bottom face of the elastic element 23 and the bottom faces of the intermediate groove 37*a* and the wrap grooves 38*a* and 38*b* and by an elastic force of the elastic element 23. This makes it possible to reliably prevent the escape of the compressed fluid.

(4) The lengths of the outer and inner peripheral seal portions 122 and 123 of the intermediate seal member 12 extending along the tip of the fixed wrap 36 may be altered, as needed.

(5) The compression chamber may be divided into three or more stages.

The constituent elements mentioned in the claims and the description may be arbitrarily combined or omitted within a scope where at least part of the issues discussed above can be solved or within a scope where at least part of advantages can be provided.

What is claimed is:

1. A scroll fluid machine comprising:

a fixed scroll including a first mirror surface and a fixed wrap protruding in a spiral shape from the first mirror surface to define a compression chamber;

an orbiting scroll including a second mirror surface opposed to the first mirror surface of the fixed scroll, and an orbiting wrap protruding in a spiral shape from the second mirror surface;

a land located in such a position so as to divide the compression chamber into a first-stage compression chamber and a second-stage compression chamber, the land including a first-stage outlet in communication with the first-stage compression chamber and a second-stage inlet in communication with the second-stage compression chamber;

a wrap groove defined in a spiral shape along a tip of the fixed wrap, and including an outer peripheral wrap groove adjacent to the first-stage outlet and the second-stage inlet on a radially outward side and an inner peripheral wrap groove adjacent to the first-stage outlet and the second-stage inlet on a radially inward side;

an intermediate groove defined in the land and in communication with the outer peripheral wrap groove and the inner peripheral wrap groove;

a seal member fitted in the wrap groove except the outer peripheral wrap groove and the inner peripheral wrap groove; and an intermediate seal member including an outer peripheral seal portion fitted in the outer peripheral wrap groove, an inner peripheral seal portion fitted in the inner peripheral wrap groove, and an intermediate seal portion fitted in the intermediate groove and connected to the outer peripheral seal portion and the inner peripheral seal portion, wherein the seal member comprises:

a first seal member including a second end face in contact with a first end face of the outer peripheral seal portion, the first seal member extending in a spiral shape from the second end face in a radially outward direction;

a second seal member including a fourth end face in contact with a third end face opposed to the first end face of the outer peripheral seal portion, and a sixth end face in contact with a fifth end face of the inner peripheral seal portion and opposed to the fourth end face, the second seal member extending in a spiral shape from the fourth end face to the sixth end face in a radially inward direction; and a third seal member including an eighth end face in contact with a seventh end face opposed to the fifth end face of the inner peripheral seal portion, the third seal member extending in a spiral shape from the eighth end face in the radially inward direction.

2. The scroll fluid machine of claim 1, wherein cuts are defined in a lateral face of the intermediate seal member at an angle to a direction orthogonal to a longitudinal direction to thereby define elastically deformable lips.

3. The scroll fluid machine of claim 1, wherein a backup ring made of elastic material is positioned in a bottom face of the intermediate seal member.

* * * * *